US010485369B2

(12) United States Patent
Rapp et al.

(10) Patent No.: US 10,485,369 B2
(45) Date of Patent: Nov. 26, 2019

(54) CHRISTMAS TREE STAND

(71) Applicant: Patent Innovations LLC, Pittsford, NY (US)

(72) Inventors: Steve Rapp, Rochester, NY (US); John M. Hammond, Livonia, NY (US)

(73) Assignee: Patent Innovations LLC, Pittsford, NY (US)

( * ) Notice: Subject to any disclaimer, the term of this patent is extended or adjusted under 35 U.S.C. 154(b) by 0 days.

(21) Appl. No.: 16/252,748

(22) Filed: Jan. 21, 2019

(65) Prior Publication Data

US 2019/0150649 A1 May 23, 2019

Related U.S. Application Data

(63) Continuation of application No. 15/655,921, filed on Jul. 21, 2017, now Pat. No. 10,182,677.

(Continued)

(51) Int. Cl.
*A47G 33/12* (2006.01)

(52) U.S. Cl.
CPC .. *A47G 33/1226* (2013.01); *A47G 2033/1286* (2013.01)

(58) Field of Classification Search
USPC ..... 248/519, 521, 523, 524, 525, 526, 527, 248/516
See application file for complete search history.

(56) References Cited

U.S. PATENT DOCUMENTS 1,645,023 A 1/1926 Richards
1,781,643 A 11/1930 Irwin (Continued)

FOREIGN PATENT DOCUMENTS

DE 3421733 A1 12/1985
EP 0240786 A1 3/1987
WO 2011156701 A2 12/2011

OTHER PUBLICATIONS

Office Action in U.S. Appl. No. 13/691,771 dated Apr. 2, 2015; EFS file name 20190424_16-252748_IDS_NPL_Cite1.

(Continued)

*Primary Examiner* — Alfred J Wujciak
(74) *Attorney, Agent, or Firm* — John M. Hammond; Patent Innovations LLC

(57) ABSTRACT

A tree stand comprising a supporting base, a positioning sphere, and a compression collar. The supporting base is comprised of an annular cavity surrounding upwardly facing hemispherical socket. The annular cavity comprises an outer side wall including an upper threaded portion. The positioning sphere includes an outer spherical surface and a cavity for receiving a trunk of the tree. The compression collar comprised an outer threaded wall engageable with the upper threaded portion of the supporting base, and a first flange contactable with an upper portion of the outer spherical surface of the positioning sphere. When the positioning sphere is disposed in the hemispherical socket, and the compression collar is maximally threadably engaged with the supporting base, the flange of the compression collar is contacted with the outer spherical surface of the positioning sphere and immobilizes the sphere in the socket, thereby securing the tree in a desired upright position.

11 Claims, 8 Drawing Sheets

Related U.S. Application Data

(60) Provisional application No. 62/366,079, filed on Jul. 24, 2016.

(56) References Cited

U.S. PATENT DOCUMENTS

| | | | | | |
|---|---|---|---|---|---|
| 2,543,849 | A | | 3/1951 | Hendrickson | |
| 2,893,668 | A | | 7/1959 | Applegate | |
| 2,933,274 | A | | 4/1960 | Mausolf | |
| 2,997,264 | A | * | 8/1961 | Zelenitz | A47G 33/1226 248/182.1 |
| 3,051,423 | A | | 8/1962 | Wagner et al. | |
| 3,142,464 | A | | 7/1964 | Zelenitz | |
| 3,298,642 | A | | 1/1967 | Taylor | |
| 3,661,349 | A | | 5/1972 | De Vries | |
| 4,076,205 | A | | 2/1978 | Almer et al. | |
| 4,156,323 | A | | 5/1979 | Scheffler | |
| 4,531,855 | A | | 7/1985 | Wallis | |
| 4,541,601 | A | * | 9/1985 | Corbisello | A47G 33/1226 248/516 |
| 4,571,882 | A | | 2/1986 | Capen | |
| 5,301,462 | A | | 4/1994 | Hronyetz | |
| 5,393,031 | A | | 2/1995 | Leve | |
| 5,398,444 | A | | 3/1995 | Murray | |
| 5,492,301 | A | | 2/1996 | Hauser | |
| 5,507,117 | A | | 4/1996 | Kalman et al. | |
| 5,707,037 | A | | 1/1998 | Pastrick | |
| 5,845,890 | A | * | 12/1998 | Earsley | A47G 33/1226 248/516 |
| 6,010,108 | A | | 1/2000 | Welzen | |
| 6,019,341 | A | | 2/2000 | Brown et al. | |
| 6,129,325 | A | | 10/2000 | Niklas | |
| 9,375,109 | B2 | | 6/2016 | Hammond et al. | |
| 10,182,677 | B2 | * | 1/2019 | Rapp | A47G 33/1226 |
| 2005/0257422 | A1 | | 11/2005 | Hronyetz | |

OTHER PUBLICATIONS

Office Action in U.S. Appl. No. 13/691,771 dated Nov. 30, 2015; EFS file name 20190424_16-252748_IDS_NPL_Cite2.

Office Action in U.S. Appl. No. 15/193,064 dated Jan. 24, 2017; EFS file name 20190424_16-252748_IDS_NPL_Cite3.

Office Action in U.S. Appl. No. 15/193,064 dated Jul. 19, 2017; EFS file name 20190424_16-252748_IDS_NPL_Cite4.

Office Action in U.S. Appl. No. 15/193,064 dated Jan. 23, 2018; EFS file name 20190424_16-252748_IDS_NPL_Cite5.

Office Action in U.S. Appl. No. 15/193,064 dated Aug. 9, 2018; EFS file name 20190424_16-252748_IDS_NPL_Cite6.

Office Action in U.S. Appl. No. 15/193,064 dated Feb. 22, 2019; EFS file name 20190424_16-252748_IDS_NPL_Cite7.

* cited by examiner

CHRISTMAS TREE STAND

CROSS-REFERENCE TO RELATED PATENT APPLICATIONS

This application is a continuation of copending U.S. patent application Ser. No. 15/655,921, filed on Jul. 21, 2017, which claims the benefit of U.S. Provisional Patent Application No. 62/366,079 filed Jul. 24, 2016, the disclosures of which are incorporated herein by reference. The above benefit/priority claims are being made in an Application Data Sheet submitted herewith in accordance with 37 C.F.R. 1.76 (b)(5) and 37 C.F.R. 1.78. This application is also related to commonly owned U.S. patent application Ser. No. 15/193,064 filed Jun. 26, 2016, which is a continuation of commonly owned U.S. patent application Ser. No. 13/691,771, filed on Dec. 1, 2012, and issued as U.S. Pat. No. 9,375,109 on Jun. 28, 2016, which claims priority from U.S. Provisional Patent Application No. 61/565,597 filed Dec. 1, 2011, the disclosures of which are incorporated herein by reference.

BACKGROUND

Technical Field

Support stands for longitudinal objects, and in particular, support stands for Christmas trees, posts, poles, and similar objects.

Description of Related Art

A variety of stands for Christmas trees have been produced over the many centuries of the Christmas tree tradition. Some of the key requirements and/or attributes of a Christmas tree stand are as follows:

- Accepts a range of sizes and shapes of tree trunks.
- Easy to secure to the tree.
- Easy to erect the tree.
- Holds the tree up straight and firmly maintains a straight position over the entire period of use.
- Holds sufficient water to keep the tree hydrated.
- Stable—no wobble when erected.
- Simple construction with minimal parts.
- Assembly and erection requires only common household tools.

In spite of the efforts of many individuals to provide a satisfactory Christmas tree stand, there remains a need for a stand that has these attributes, and that can be provided at a relatively low cost.

SUMMARY

In accordance with the present disclosure, the problem of supporting a Christmas tree is solved by a Christmas tree stand comprising a supporting base, a positioning sphere, and a compression collar. The supporting base is comprised of an annular cavity surrounding an upwardly facing hemispherical socket. The annular cavity is bounded by an outer side wall including an upper threaded portion. The positioning sphere includes an outer spherical surface and a cavity for receiving a trunk of the tree. The compression collar is comprised an outer threaded wall engageable with the upper threaded portion of the supporting base, and a first flange contactable with an upper portion of the outer spherical surface of the positioning sphere. When the positioning sphere is disposed in the hemispherical socket, and the compression collar is maximally threadably engaged with the supporting base, the flange of the compression collar is contacted with the outer spherical surface of the positioning sphere and immobilizes the sphere in the socket. In that manner, a tree to which the stand is fitted may be secured in a desired straight upright position.

In certain embodiments, the positioning sphere may be comprised of a plurality of external fins including external edges that define the outer spherical surface of the sphere. The positioning sphere may further include a plurality of ports formed radially around the sphere, each of the ports disposed between adjacent fins of the sphere. In such embodiments, the tree stand may further comprise a plurality of screws fittable into the ports through a side wall forming the cavity of the positioning sphere. The screws may be driven into the trunk of the tree to secure the positioning sphere to the tree.

In certain embodiments, the upwardly facing hemispherical socket of the supporting base may be comprised of a plurality of spherically surfaced cups extending beneath the annular cavity of the supporting base. In embodiments in which the positioning sphere is comprised of a plurality of external fins with external edges that define the outer spherical surface of the sphere, adjacent pairs of spherically surfaced cups of the supporting base may form first passageways extending from the annular cavity to the external fins of the positioning sphere, and the positioning sphere may be comprised of second passageways extending between adjacent pairs of fins through a side wall forming the cavity of the positioning sphere. The first passageways may be in communication with the second passageways, such that water for hydration of the tree may be delivered from the annular cavity to the trunk of the tree, which is disposed in the cavity of the positioning sphere.

In certain embodiments, the compression collar of the tree stand may be formed as a cylindrical disc including a plurality of spokes extending from an inner region of the disc to an outer region of the disc. In certain embodiments, the annular cavity of the supporting base may be at least partially formed by outer side wall of the supporting base, and the outer spherical surface of the positioning sphere. In certain embodiments, the supporting base may include a plurality of radially extending feet.

In certain embodiments, the positioning sphere of the tree stand may be comprised of a lag bolt embedded in a bottom wall of the cavity and comprising a threaded shank extending into the cavity. Alternatively or additionally, the tree stand may further comprise a plurality of wedges disposable between the trunk of the tree and a side wall of the cavity of the positioning sphere. The wedges may each include a curvilinear ramp surface engageable with an upper edge of the side wall of the cavity of the positioning sphere. The wedges may each include a ramp surface with a plurality of engagement features, such as angled steps or notches. The wedges may each include a tree engagement surface with a plurality of engagement features, such as teeth or pegs. The wedges may each include a spike protruding diagonally from a tree engagement surface.

BRIEF DESCRIPTION OF THE DRAWINGS

The present disclosure will be provided with reference to the following drawings, in which like numerals refer to like elements, and in which.

DETAILED DESCRIPTION

Figure 1:
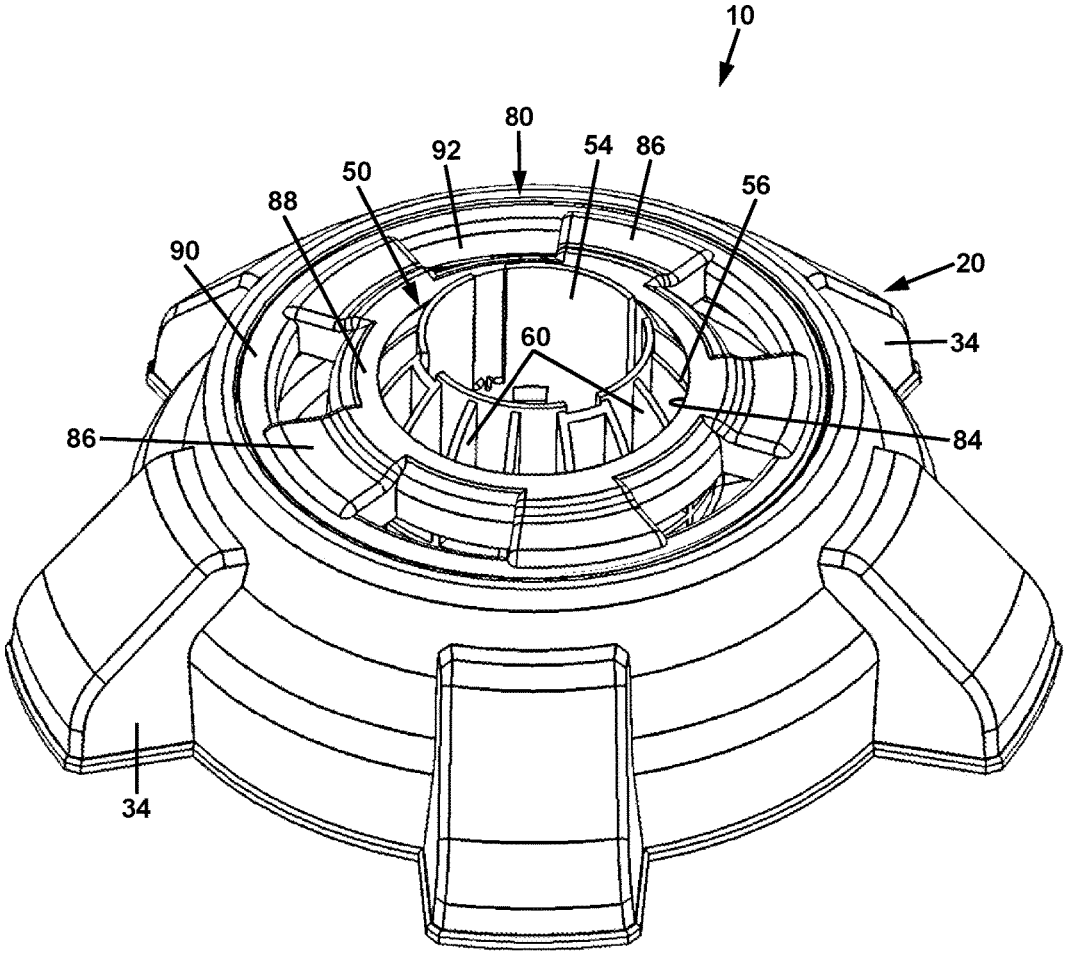
FIG. 1 is an upper perspective view of a tree stand of the present disclosure.
Figure 2:
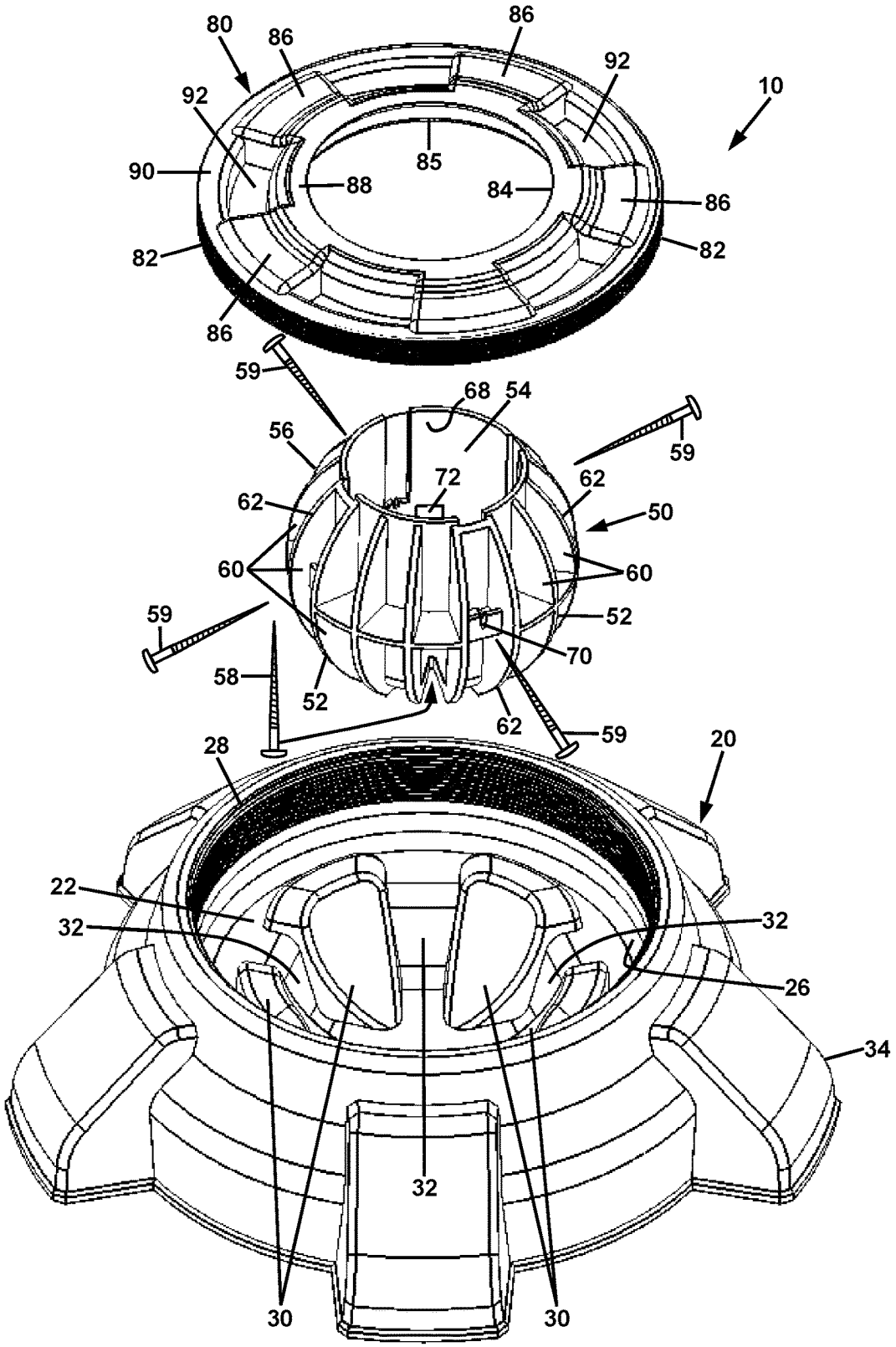
FIG. 2 is an exploded upper perspective view of the tree stand of FIG. 1.

The present invention will be described in connection with certain preferred embodiments. However, it is to be understood that there is no intent to limit the invention to the embodiment described. On the contrary, the intent is to cover all alternatives, modifications, and equivalents as may be included within the spirit and scope of the invention as defined by the appended claims.

For a general understanding of the present invention, reference is made to the drawings. In the drawings, like reference numerals have been used throughout to designate identical elements. In the following disclosure, the present invention is described in the context of its use as a tree stand. However, it is not to be construed as being limited only to use in supporting cut trees, such as Christmas trees. The invention is adaptable to any use in which adjustable support is desirable to be provided for a longitudinal object such as a post or pole. Additionally, the description identifies certain components with the adjectives "top," "upper," "bottom," "lower," "left," "right," etc. These adjectives are provided in the context of use of the stand for supporting a tree vertically, and in the context of the orientation of the drawings. The description is not to be construed as limiting the stand to use in a particular spatial orientation. The instant stand may be used in orientations other than those shown and described herein.

The structure and use of the present Christmas tree stand will now be described with reference to FIGS. 1-9D. The Christmas tree stand 10 is comprised of a supporting base 20, a positioning sphere 50, and a compression collar 80. The supporting base 20 is comprised of an annular cavity 22 surrounding an upwardly facing hemispherical socket 24. The annular cavity 22 is bounded by an outer side wall 26 including an upper threaded portion 28. The positioning sphere 50 includes an outer spherical surface 52 and a cavity 54 for receiving a trunk 4 of the tree 2. The compression collar 80 is comprised an outer threaded wall 82 engageable with the upper threaded portion 28 of the supporting base 20, and a first flange 84 contactable with an upper portion 56 of the outer spherical surface 52 of the positioning sphere 50.

When the positioning sphere 50 is disposed in the hemispherical socket 24, and the compression collar 80 is maximally threadably engaged with the supporting base 20, the flange 84 of the compression collar 80 is contacted with the outer spherical surface 52 of the positioning sphere 50 and immobilizes the sphere 50 in the socket.

Figure 6:
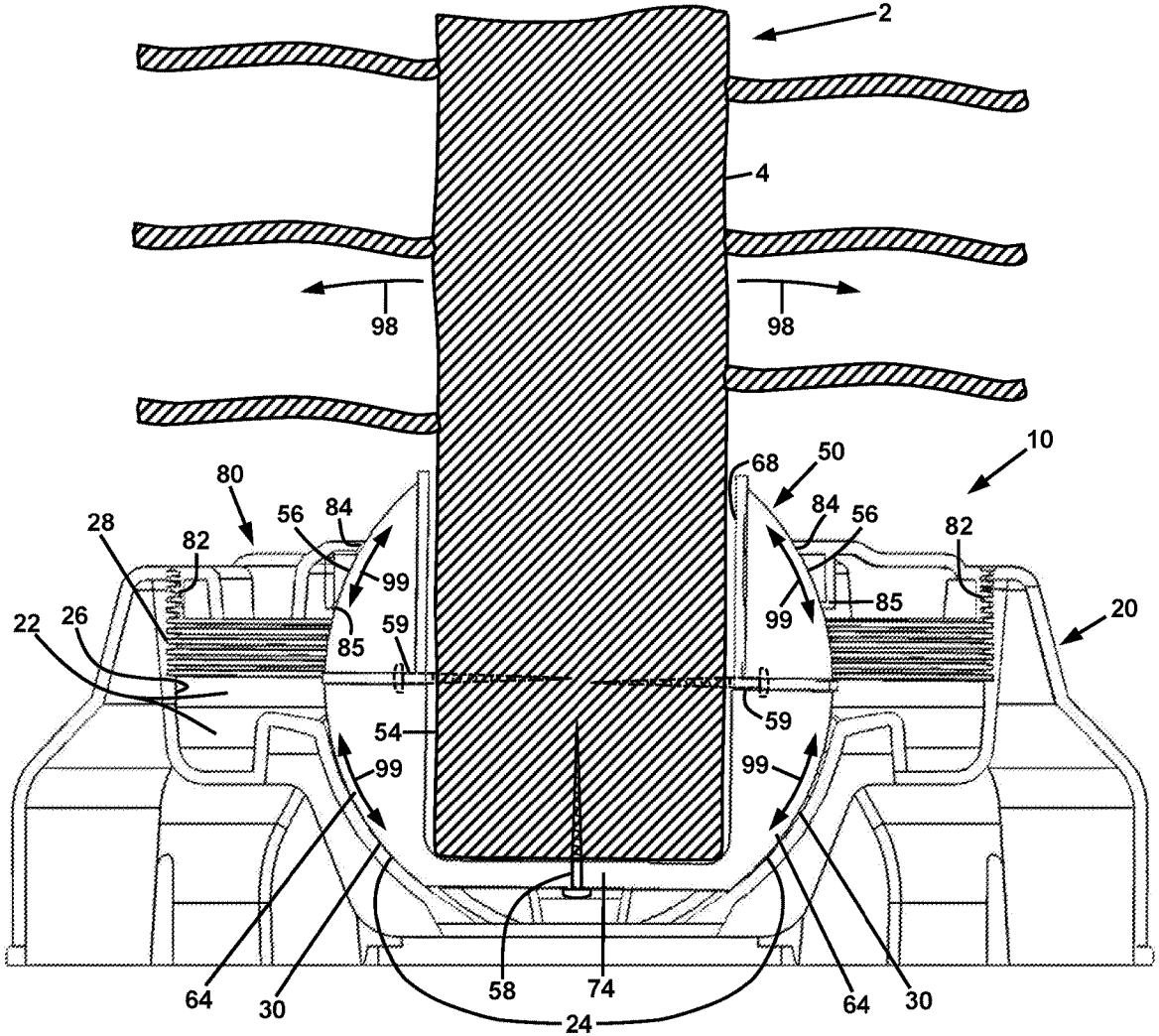
FIG. 6 is a side cross-sectional view of the tree stand of FIG. 1 shown fitted to a tree and in the standing position, and showing a first manner of securing a tree in the tree stand.
Figure 7A:
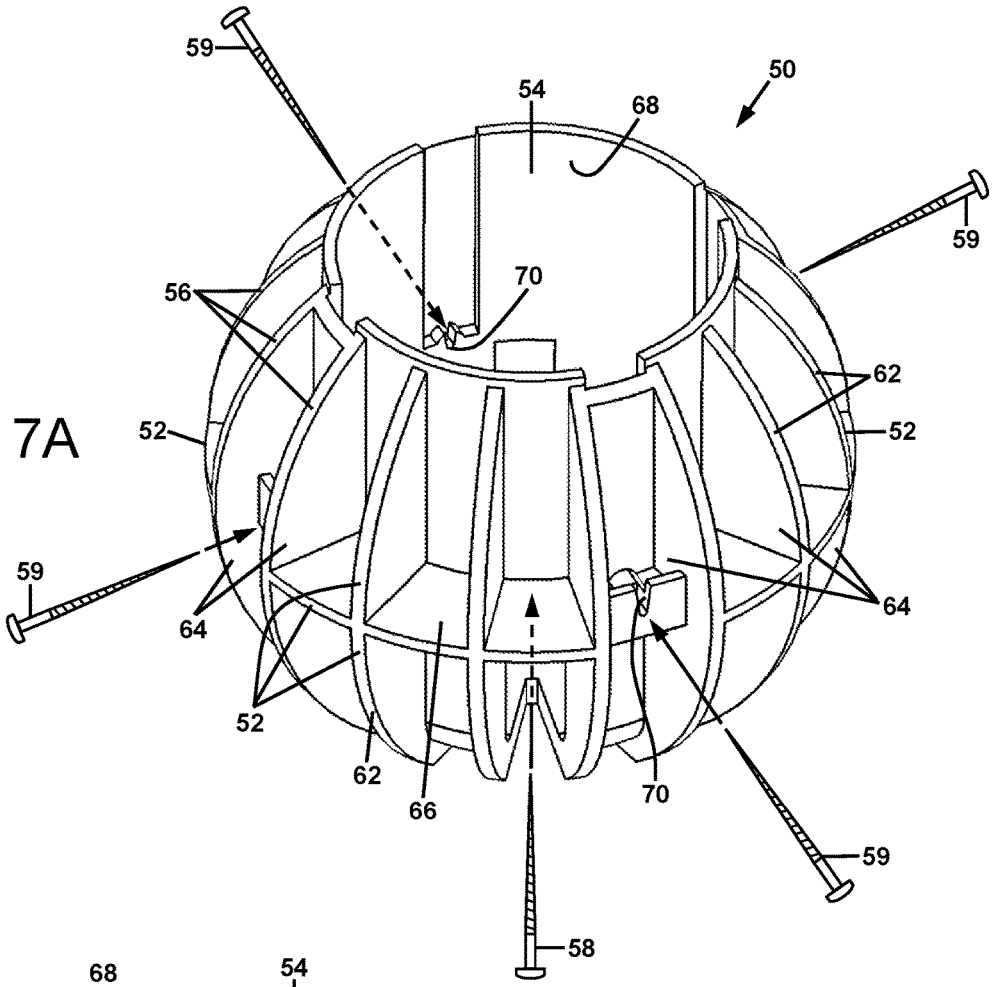
FIG. 7A is detailed upper perspective view of the positioning sphere of the tree stand as depicted in FIG. 2.
Figure 7B:
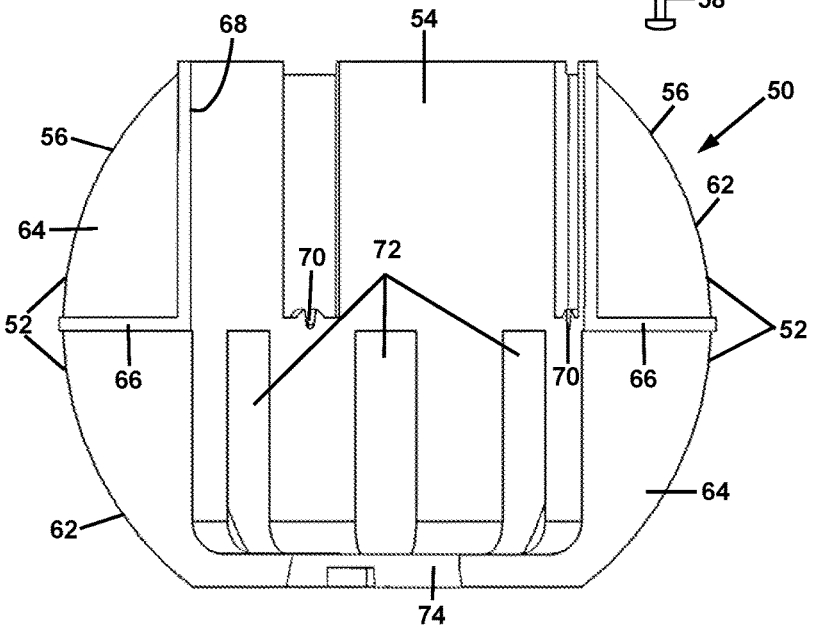
FIG. 7B is a side cross-sectional view of the positioning sphere of the tree stand.

Referring in particular to FIG. 6, in fitting the Christmas tree stand 10 to the tree 2, the collar 80 is slid over the trunk 4 of the tree 2, preferably while the tree 2 is lying down horizontally. The positioning sphere 50 is attached to the trunk 4 of the tree 2, with the trunk 4 disposed in the positioning sphere cavity 54. The attachment of the sphere 50 to the tree trunk 4 may be accomplished by suitable fastening means. In the embodiment depicted in FIGS. 1-7B (and particularly with reference to FIGS. 2, 6, and 7A), the tree stand 10 is provided with a base screw 58 and radial screws 59 for such fastening.

Referring again to FIG. 6, the supporting base 20 is then secured to the positioning sphere 50, such that the sphere 50 is seated in the hemispherical socket 24 of the base 20. To accomplish this, the threads 82 of the compression collar are engaged with the threads 28 of the supporting base, thereby contacting the flange 84 with the upper portion 56 of the outer spherical surface 52 of the positioning sphere 50, and immobilizing the sphere 50 in the socket 24. With such threads 82/28 tightened to each other to immobilize the sphere 50, the assembled tree 2 and stand 10 may then be stood up, such that the tree 2 is supported by the stand 10 in an upright position.

The compression collar 80 may then be unscrewed slightly from the base 20 to allow further adjustment of the position of the sphere 50 within the socket 24 as indicated by bidirectional arrows 99, and therefore, adjustment of the vertical position of the trunk 4 of the tree 2. The position of the tree 2 is adjusted as indicated by arrows 98 (which may be as needed in any horizontal direction other than the drawing plane of FIG. 6) so that the trunk 4 of the tree 2 is vertical (straight up) and thus aesthetically appealing. The collar 80 may then be retightened to the base 20 so that the tree 2 is secured in a desired straight upright position.

Other aspects of the instant tree stand will now be described.

In certain embodiments, the positioning sphere 50 may be comprised of a plurality of external fins 60 including external edges 62 that define the outer spherical surface 52 of the sphere. In the embodiment depicted in FIGS. 1-7B, the plurality of fins 60 include an array of vertical fins 64, and a central horizontal fin 66. Other patterns of fins are contemplated. It is preferable that the pattern of fins 60 is such that regardless of the position of the sphere 50 within the hemispherical socket 24, that each spherically surfaced cup 30 (to be described subsequently) of the supporting base 20 is in contact with at least two fins 60.

The positioning sphere 50 may further include a plurality of ports 70, formed radially around the sphere 50. The ports 70 may be disposed between adjacent fins 64 of the sphere 50. As described previously, in such embodiments, the tree stand 10 may further comprise a plurality of screws 59 fittable into the ports 70 through a side wall 68 forming the cavity 54 of the positioning sphere 50. The radial screws 59 and the base screw 58 may be driven into the trunk 4 of the tree 2 to secure the positioning sphere 50 to the tree 2. It is noted that by virtue of the adjustability of the position of the sphere 50 within the hemispherical socket 24 of the supporting base 20, the positioning sphere 50 does not need to be fitted to the trunk 4 of the tree 2 with a high level of precision. Unlike the depiction in FIG. 6, the sphere 50 can be fitted crookedly on the tree trunk 4 and/or off-center on the tree trunk 4, and the sphere 50 will still have sufficient adjustability within the hemispherical socket 24 to enable supporting the tree 2 in an aesthetically pleasing "straight up" position. In the embodiment of the stand 10 depicted in FIGS. 1-7B, as much as ±12 degrees of adjustment of the positioning sphere 50 in the hemispherical socket 24 is available to ensure straight up positioning of a tree 2.

In certain embodiments, the upwardly facing hemispherical socket 24 of the supporting base 20 may be comprised of a plurality of spherically surfaced cups 30 extending beneath the annular cavity 22 of the supporting base 20. In embodiments in which the positioning sphere 50 is comprised of a plurality of external fins 60 with external edges 62 that define the outer spherical surface 52 of the sphere 50, adjacent pairs of spherically surfaced cups 30 of the supporting base may form first passageways 32 between them, which extend from the annular cavity 22 to the external fins 60 of the positioning sphere 50, and beneath the sphere 50. Additionally, the positioning sphere 50 may be comprised of second passageways 72 extending between adjacent pairs of fins 60 through the side wall 68 forming the cavity 54 of the positioning sphere 50. The first passageways 32 may be in communication with the second passageways 72, such that water for hydration of the tree may be delivered from the annular cavity 22 to the trunk 4 of the tree 2, which is disposed in the cavity 54 of the positioning sphere 50. The positioning sphere 50 may be provided with third passageways (not shown) that extend through the bottom wall 74 of the sphere 50.

In certain embodiments, the compression collar 80 of the tree stand may be formed as a cylindrical disc including a plurality of spokes 86 extending from an inner region 88 of the disc to an outer region 90 of the disc. Openings 92 are formed between interspersed between adjacent pairs of spokes 86. These multiple openings 92 are advantageous, in that they provide locations for a user (not shown) of the stand 10 to add water to the annular cavity 22 of the stand 10 for hydration of the tree 2, from any point on the floor (not shown) around the stand 10, without needing to remove any part of the stand 10. Additionally, the openings 92 provide very firm gripping locations for a user to engage his/her fingers, and tighten the compression collar 80 very tightly with the supporting base 20, thereby securing the sphere 50 and the tree 2 in the desired final position.

In certain embodiments, the annular cavity 22 of the supporting base 20 is at least partially formed by outer side wall 26 of the supporting base 20, and the outer spherical surface 52 and/or other exterior portions of the positioning sphere 50.

In certain embodiments, the compression collar 80 may be further comprised of a second flange 85 that is contactable with the upper portion 56 of the outer spherical surface 52 of the positioning sphere 50. In an alternative embodiment depicted in FIG. 8, the compression collar 80 may be provided with a single thick flange 87 engaging with the upper portion 56 of the outer spherical surface 52 of the positioning sphere 50. In one embodiment, the thick flange 87 is provided with a spherical contour dimensioned to match the outer spherical surface 52 of the positioning sphere 50.

In certain embodiments, the supporting base may be provided with a plurality of radially extending feet 34. The Applicant has found that such radially extending feet 34 are beneficial when tightening the compression collar 80 onto the positioning sphere 50 to immobilize the sphere 50 and the tree 2 (FIG. 6) joined thereto into a fixed position. The desired fixed position is determined by the user, who adjusts the position of the tree 2 to have an appearance of being "perfectly upright" by pivoting the tree 2 and positioning sphere 50 in the upwardly facing hemispherical socket 24. During this procedure, the compression collar 80 is just loose enough to permit the positioning sphere 50 to rotate in the socket 24, but tight enough to provide enough friction such that when the user lets go of the tree 2, it stays in position. In that manner, after just one or two simple adjustments, the "perfectly upright" position of the tree is attained, and maintained while the user performs the final tightening of the compression collar 80.

Figure 3:
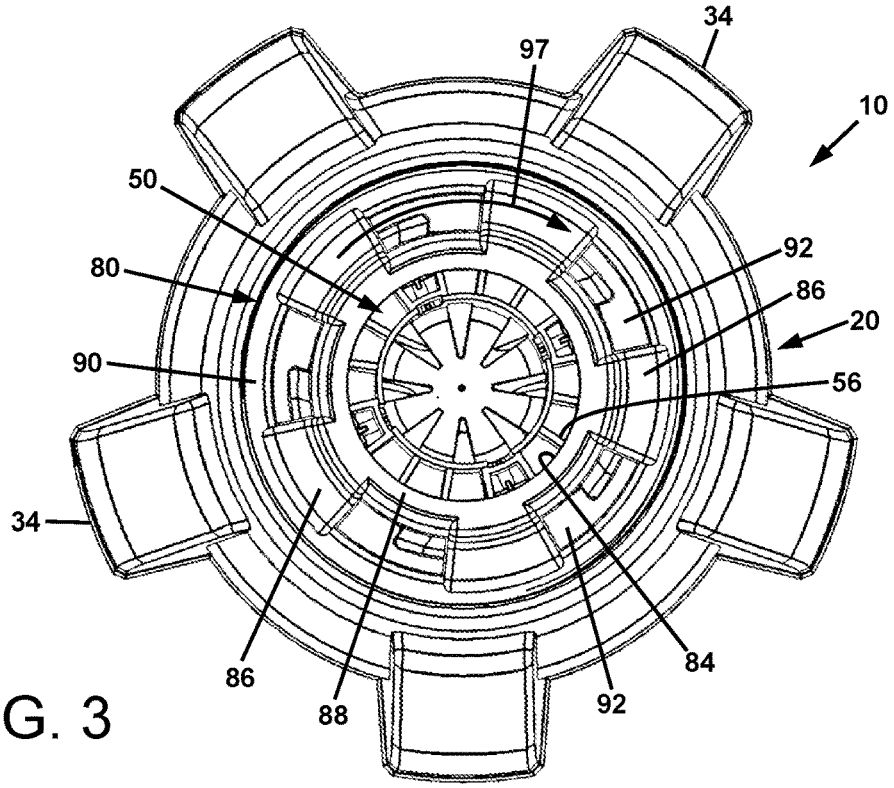
FIG. 3 is a top view of the tree stand of FIG. 1.
Figure 4:
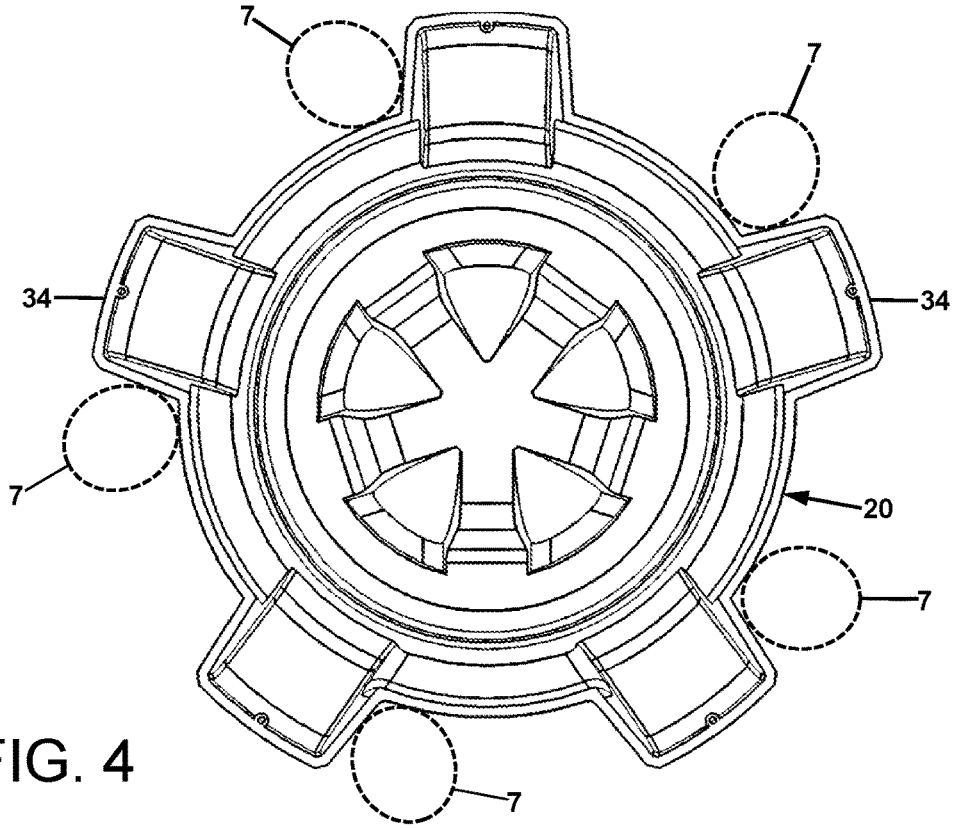
FIG. 4 is a bottom view of the tree stand of FIG. 1.
Figure 5:
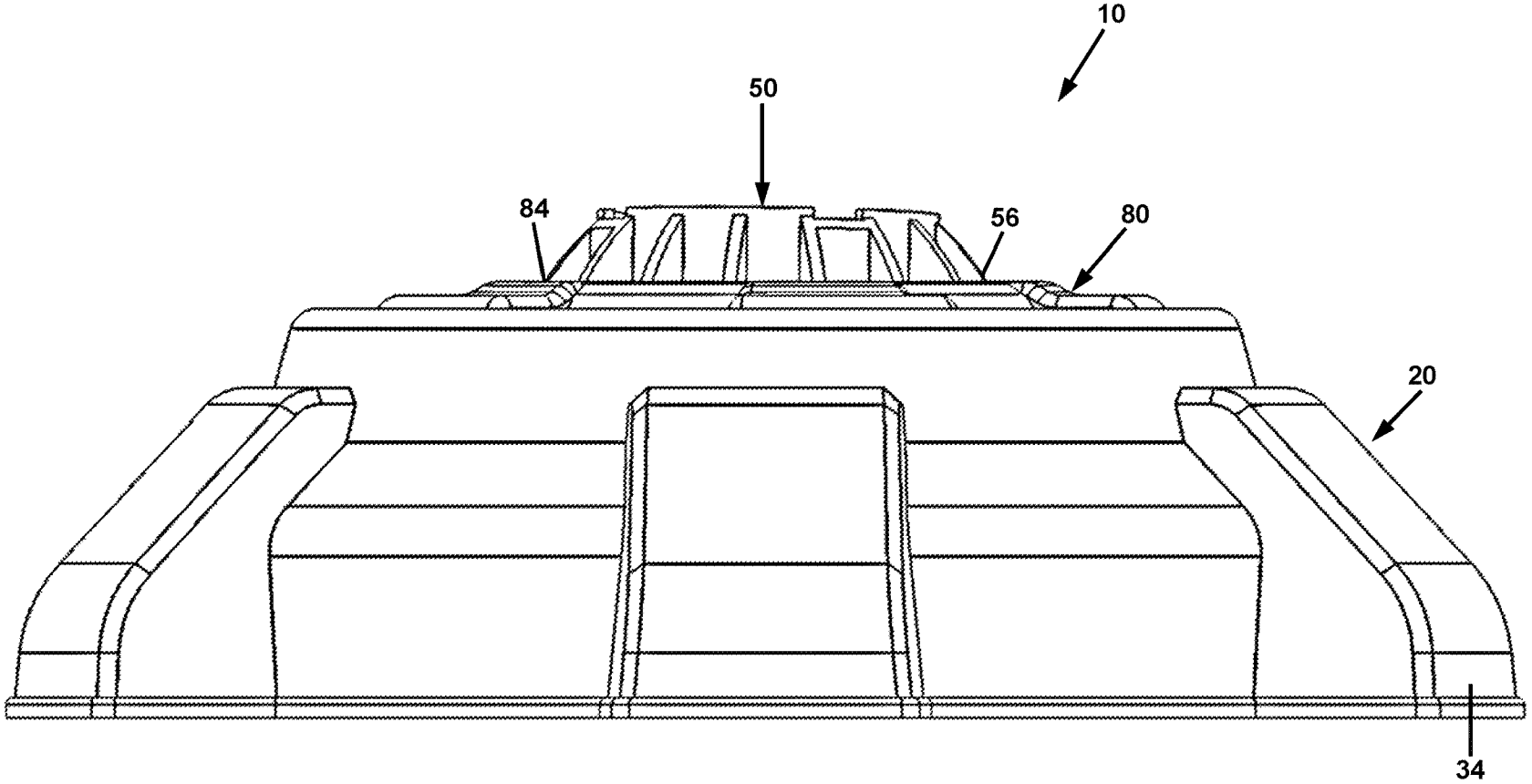
FIG. 5 is a side elevation view of the tree stand of FIG. 1.

Referring to FIG. 4, when performing the final tightening that accomplishes immobilization of the tree 2 in the stand 10, the user may take a "half kneeling" position, with one knee touching the floor and located against any one of the feet 34 in any of the positions 7 indicated in dotted line (assuming that the collar 80 and base 20 have right-hand threads, and again, pointing out that FIG. 4 is a bottom view of the base 20). Referring also to FIG. 3, the user then grasps the compression collar 80 with both hands, with his fingers extending through the openings 92 formed between the spokes 86, so that the user has a firm grip on two of the spokes 86. For example, if a user were to place his knee against the lowermost location 7 in FIG. 4, the user could grasp the spokes 86 located at three o'clock and eight o'clock on the compression collar 80 in FIG. 3. Other grasping arrangements may be more ergonomically comfortable depending upon the user. In any event, once the user has a strong grip on the spokes 86 of the compression collar 20, and with his knee firmly against a foot 34, the user has strong leverage to apply a very high clockwise torque on the collar 20 as indicated by arcuate arrow 97, thereby tightening (assuming right hand threads) the compression collar 80 strongly onto the positioning sphere 50, and thereby immobilizing the sphere 50 and the tree 2 joined thereto. When it is time to remove the tree 2 from the stand 10, and it is necessary to unscrew the compression collar 80 from the base 20, the reverse procedure may be used: the user places his knee in any one of the opposite locations against a foot 34, and applies a high counter clockwise torque on the collar 20, thereby loosening the compression collar 80.

The positioning sphere 50 of the stand 10 may be made of metal or a hard plastic, such as a polyimide, or a composite material, such as glass fiber reinforced polyester, or a carbon fiber composite. The base 20 and compression collar 80 may be made of plastic or metal, such as stainless steel, aluminum, or carbon steel, preferably painted or powder coated to prevent rust. A plastic base 20 may be molded as a single piece. The flanges 84 and 85 or flange 87 that contact the sphere 50 may be made of a high friction plastic such as polyurethane, or have a high friction coating such as a rubber or polyurethane, in order to have even stronger friction when tightened against the sphere 50.

In general, the stand 10 may be provided with combinations of materials depending upon various considerations, including manufacturing cost and appeal to a particular consumer. Lower cost versions may be made mainly of plastic, while a higher cost version appealing to higher income consumers may be made of stainless steel or an attractive colored anodized aluminum. The stand 10 may be provided with more than one positioning sphere 50, with the spheres having different sized cavities 54 for receiving different sized tree trunks 4. Alternatively a single sphere 50 may be provided with removable inserts of different cavity sizes or wedge-shaped spacers to accommodate different sized tree trunks 4.

Such alternative embodiments of a tree stand 11 with such wedge shaped spacers, or wedges, will now be described with reference to FIGS. 8-9D. The stand 11 is comprised of a base 20, a compression collar 81 as described previously, and a positioning sphere 51. The base 20 may be identical to the base 20 of the stand 10 of FIGS. 1-3, 5, and 6. The compression collar 81 may be identical to the collar 80 of the stand 10 of FIGS. 1-3, 5, and 6, or the collar 81 may include a thick flange 87 as described previously. The positioning sphere 51 is similar to the positioning sphere 50 of the stand 10 of FIGS. 1-3, 5, and 6, but also has certain important differences, which are advantageous in that they enable a "no tools" setup of a tree 2 in the Christmas tree stand 11.

Figure 8:
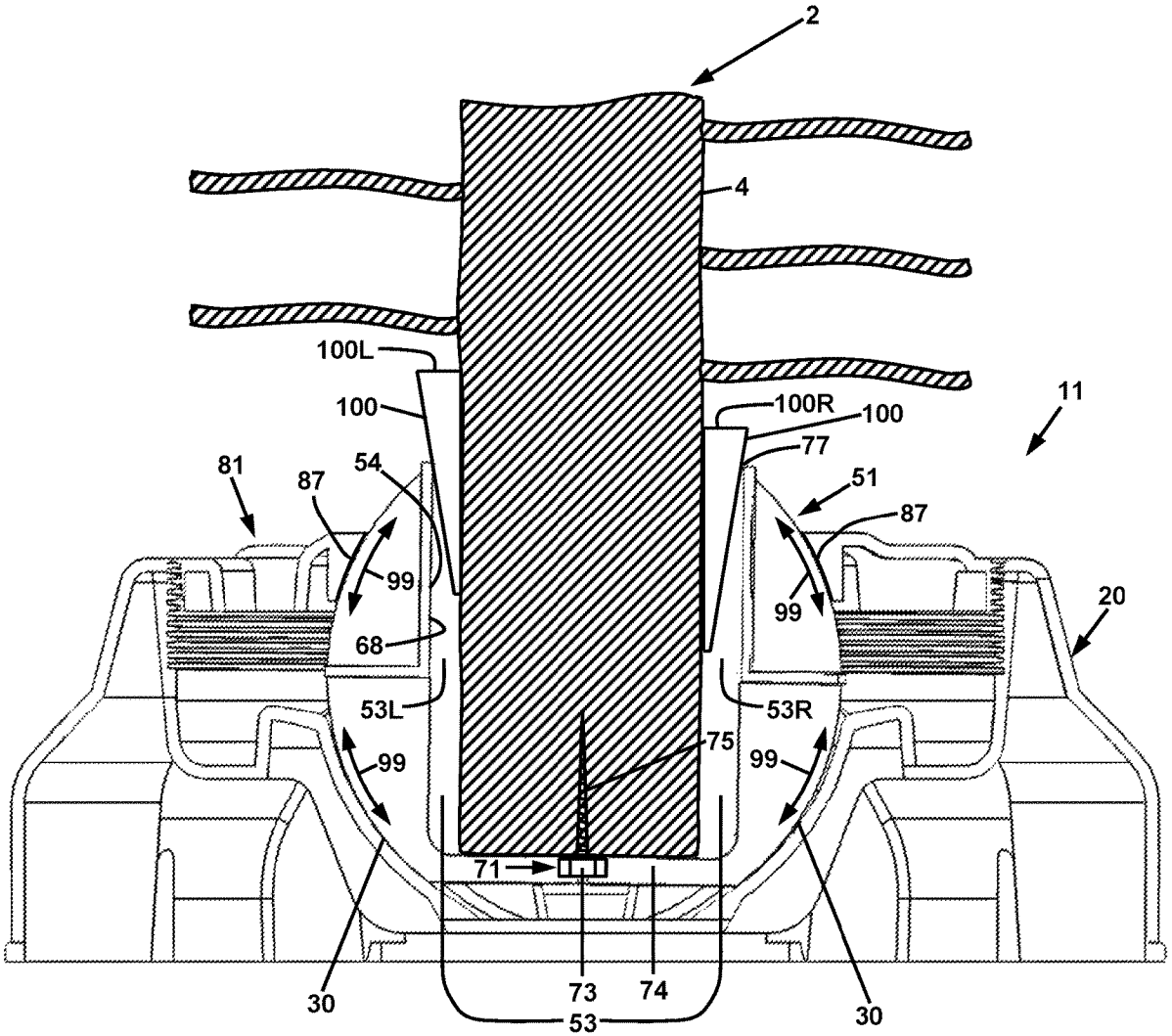
FIG. 8 is a side cross-sectional view of the tree stand of FIG. 1 shown fitted to a tree and in the standing position, and showing a second manner of securing a tree in the tree stand, including supporting wedges.

Referring to FIG. 8, instead of having a bottom port through which a fastening screw 58 (FIG. 6) passes, the positioning sphere 51 may include a lag bolt 71, which is comprised of a head 73 that is embedded in the bottom wall 74 of the sphere 51, and a threaded shank 75, which extends upwardly from the bottom wall 74. Thus it can be seen that as a first step in installing the positioning sphere 51 on the trunk 4 of the tree 2, the user may simply grasp the sphere 51 by its fins 60 (FIG. 2), and rotate the sphere 51, thereby screwing the threaded shank 75 of the bolt 71 into the tree trunk 4. No tools are needed for this step, since sufficient torque may easily be provided by hand. Additionally, it is not necessary that the trunk 4 of the tree 2 be cut perfectly square, or that the sphere 51 is threaded squarely onto the trunk 4, or centered on the trunk 4.

As a next step in installing the positioning sphere 51, a plurality of wedges 100 are forced into the gap 53 between the tree trunk 4 and the side wall 68 of the cavity 54 of the positioning sphere 51. Preferably, at least three wedges 100 are used, spaced at about 120 degree intervals around the tree trunk, although spacing may vary to accommodate small branches protruding from the tree trunk 4. In the embodiment depicted in FIG. 8, four wedges 100 are used, with two spaced at 180 degrees as shown in the plane of FIG. 8, and two more (not shown) in a plane perpendicular to FIG. 8. The wedges 100 may be forcibly jammed into the positions shown simply using hand force, thus requiring no tools for this installation step, which fully secures the positioning sphere 51 to the tree trunk 4 in a rigid and fixed position. For extra tightness, the user may rap them lightly with a small hammer, but such an action is not required unless the user lacks sufficient hand strength to jam them tightly.

It can be seen from FIG. 8 that the trunk 4 of the tree 2 is not centered in the cavity 54 of the positioning sphere 51, resulting in the region 53R of the trunk-to-wall gap 53 being larger than the region 53L. This condition is easily accommodated by wedge 100R being forced deeper than wedge 100L into the gap 53. It can also be seen that by having the width of the wedges vary significantly, tree trunks having a broad range of diameters as well as irregular cross-sectional shapes can be accommodated.

Figure 9A:
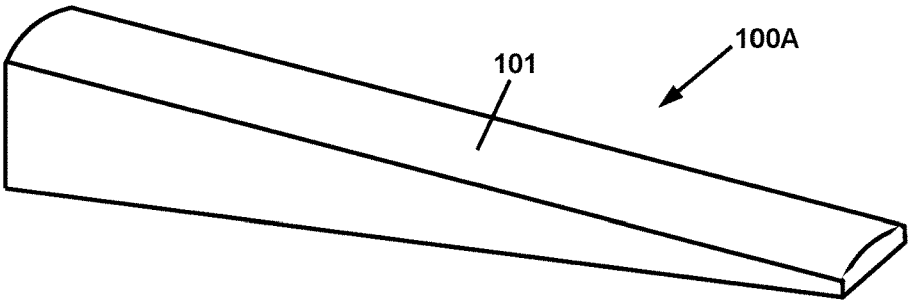
FIGS. 9A-9D depict different embodiments of supporting wedges of the tree stand of FIG. 8.

FIGS. 9A-9D depict different embodiments of supporting wedges of the tree stand of FIG. 8. The various features of the wedges of FIGS. 9A-9D serve to more firmly secure the wedges in place between the tree trunk 4 and the side wall 68 of the cavity 54 of the positioning sphere 51. Although the wedges are shown as having a right triangular shape, such a configuration is not necessary. Referring first to FIG. 9A, wedge 100A has a curvilinear ramp surface 101. The radius of curvature of surface 101 may be dimensioned so as to match the radius of curvature of the side wall 68 of the cavity 54 of the positioning sphere 51, with which it engages. Although not shown in FIGS. 9B-9D, the wedges 100B, 100C, and 100D may also have curved ramp surfaces.

Figure 9B:
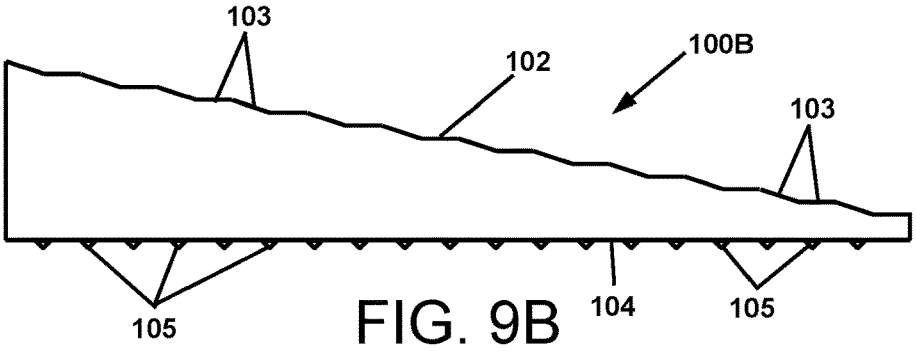

Referring to FIG. 9B, wedge 100B includes a stepped ramp surface 102 with a series of angled steps 103. As the wedge 100B is forced into the trunk-to-wall gap 53, a step 103 engages with the upper inner edge 77 (FIG. 8) of the side wall 68 of the cavity 54 of the positioning sphere 51, at a location where the wedge 100B has a thickness approximately equal to the trunk to wall gap 53. Additionally, the tree engagement surface 104 of the wedge 100B has protruding engagement teeth 105 which bite into the tree trunk 4 when the wedge 100B is forced into the trunk-to-wall gap 53.

Figure 9C:
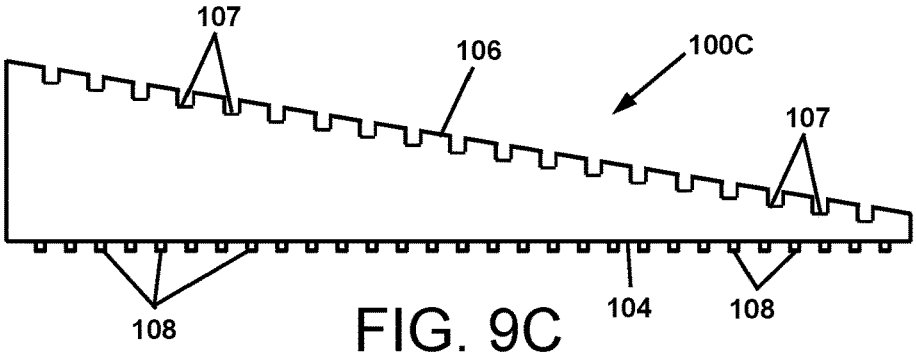

Referring to FIG. 9C, wedge 100C includes a notched ramp surface 106 with a series of spaced notches 107. As the wedge 100B is forced into the trunk-to-wall gap 53, a notch 107 engages with the upper inner edge 77 (FIG. 8) of the side wall 68 of the cavity 54 of the positioning sphere 51, at a location where the wedge 100B has a thickness approximately equal to the trunk to wall gap 53. Additionally, the tree engagement surface 104 of the wedge 100C has protruding engagement pegs 108 which bite into the tree trunk 4 when the wedge 100B is forced into the trunk-to-wall gap 53.

Figure 9D:
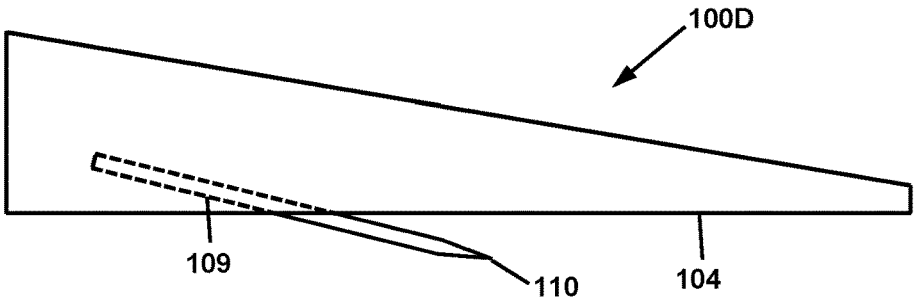

Referring to FIG. 9D, wedge 100D includes a nail or sharply pointed spike 109 embedded in the body of the wedge. As the wedge 100D is forced into the trunk-to-wall gap 53, the pointed end 110 of the spike 109 is embedded into the trunk 4 of the tree 2.

It will be apparent that other embodiments of wedges, with alternative combinations of the features of wedges 100A-100D may be provided to serve the same purpose. Additionally, in an alternative embodiment, the embedded lag screw 71 may be provided with a much longer and thicker shank 75, extending upwardly proximate to the upper edge 77 of the side wall 68 of the cavity 54 of the positioning sphere 51, such that the engagement of threaded shank 75 alone is sufficient to rigidly secure the positioning sphere 51 to the tree trunk 4, without the need for the wedges 100.

It is, therefore, apparent that there has been provided, in accordance with the present invention, a support stand for a Christmas tree. Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

We claim:

1. A method of positioning a cut tree comprising a tree trunk including an exposed trunk region terminating at a trunk end in a tree stand comprising a compression collar, a positioning sphere, and a supporting base, the method comprising:

a) extending the trunk end and exposed trunk region of the tree through a central opening of the compression collar;

b) placing the trunk end and a proximal portion of the exposed trunk region of the tree into a cavity of the positioning sphere;

c) joining the positioning sphere to the trunk end and the proximal portion of the exposed trunk region of the tree;

d) disposing the positioning sphere such that a first portion of an outer spherical surface is contiguous with a hemispherical socket of the supporting base;

e) joining the compression collar to the supporting base such that a flange of the compression collar contacts a second portion of the outer spherical surface of the positioning sphere and immobilizes the sphere in the socket.

2. The method of claim 1, wherein the tree trunk of the cut tree is disposed in a horizontal position relative to a horizontal floor surface, and the method further comprises moving the cut tree and tree stand such that the tree trunk of the cut tree is in an approximately vertical position relative to the horizontal floor surface.

3. The method of claim 2, further comprising loosening the compression collar relative to the supporting base, adjusting the position of the cut tree such that the tree trunk is in a precisely vertical position relative to the horizontal floor surface, and rejoining the compression collar to the supporting base such that the flange of the compression collar contacts the second portion of the outer spherical surface of the positioning sphere and immobilizes the sphere in the socket.

4. The method of claim 2, further comprising filling a portion of an annular cavity with water, the annular cavity bounded by an upper side wall of the supporting base and in communication with the trunk end of the tree through at least one passageway extending from the outer spherical surface of the positioning sphere to the cavity of the positioning sphere.

5. The method of claim 1, wherein the joining the compression collar to the supporting base is comprised of engaging an outer threaded wall of the compression collar with an inner threaded wall of the supporting base, and rotating the compression collar in a first direction relative to the supporting base until the flange of the compression collar contacts the second portion of the outer spherical surface of the positioning sphere.

6. The method of claim 5, wherein the tree trunk of the cut tree is disposed in a horizontal position relative to a horizontal floor surface, and the method further comprises moving the cut tree and tree stand such that the tree trunk of the cut tree is in an approximately vertical position relative to the horizontal floor surface.

7. The method of claim 6, further comprising rotating the compression collar in a second direction, opposite the first direction, relative to the supporting base sufficient to enable rotation of the positioning sphere in the hemispherical socket, adjusting the position of the cut tree such that the tree trunk is in a precisely vertical position relative to the horizontal floor surface, and rotating the compression collar in the first direction relative to the supporting base such that the flange of the compression collar contacts the second portion of the outer spherical surface of the positioning sphere and immobilizes the sphere in the socket.

8. The method of claim 7, further comprising filling a portion of an annular cavity with water, the annular cavity bounded by an upper side wall of the supporting base and in communication with the trunk end of the tree through at least one port extending from the outer spherical surface of the positioning sphere to the cavity of the positioning sphere.

9. The method of claim 1, wherein the joining the positioning sphere to the trunk end and the proximal portion of the exposed trunk region of the tree is comprised of engaging a first screw through a bottom port of the positioning sphere through the trunk end and into the proximal portion of the exposed trunk region of the tree, and engaging a plurality of screws through a plurality of respective lateral ports of the positioning sphere into the proximal portion of the exposed trunk region of the tree.

10. The method of claim 1, wherein the joining the positioning sphere to the trunk end and the proximal portion of the exposed trunk region of the tree is comprised of engaging a first screw through a bottom port of the positioning sphere through the trunk end and into the proximal portion of the exposed trunk region of the tree, and engaging a plurality of wedges within an annular gap between a side wall of the cavity of the positioning sphere and the proximal portion of the exposed trunk region of the tree.

11. The method of claim 1, wherein the positioning sphere is comprised of a lag bolt embedded in a bottom wall of the positioning sphere and comprising a threaded shank extending axially into the cavity of the positioning sphere, and wherein the joining the positioning sphere to the trunk end and the proximal portion of the exposed trunk region of the tree is comprised of rotating the positioning sphere relative to the trunk end and proximal portion of the exposed trunk region of the tree and causing the threaded shank to become embedded in the proximal portion of the exposed trunk region of the tree, and engaging a plurality of wedges within an annular gap between a side wall of the cavity of the positioning sphere and the proximal portion of the exposed trunk region of the tree.

* * * * *